US011918128B2

(12) United States Patent
Weiss

(10) Patent No.: US 11,918,128 B2
(45) Date of Patent: Mar. 5, 2024

(54) DISC FOR REFRIGERATION UNIT AND REFRIGERATION UNIT

(71) Applicant: PAN-DUR HOLDING GMBH & CO. KG, Boxberg (DE)

(72) Inventor: Albert Weiss, Ravenstein (DE)

(73) Assignee: PAN-DUR HOLDING GMBH & CO. KG, Boxberg (DE)

( * ) Notice: Subject to any disclaimer, the term of this patent is extended or adjusted under 35 U.S.C. 154(b) by 49 days.

(21) Appl. No.: 17/557,432

(22) Filed: Dec. 21, 2021

(65) Prior Publication Data

US 2022/0192395 A1 Jun. 23, 2022

(30) Foreign Application Priority Data

Dec. 23, 2020 (DE) ..... 10 2020 134 893.2

(51) Int. Cl.
*A47F 3/04* (2006.01)
*A47F 3/00* (2006.01)

(52) U.S. Cl.
CPC ..... *A47F 3/0434* (2013.01); *A47F 3/001* (2013.01)

(58) Field of Classification Search
CPC ..... A47F 3/001; A47F 3/043; A47F 3/0434; A47F 3/005; A47F 3/12; A47F 3/125; F25D 23/021
See application file for complete search history.

(56) References Cited

U.S. PATENT DOCUMENTS 2,341,123 A * 2/1944 Schweller ..... F25D 23/021 312/297
2,827,118 A * 3/1958 Wendt ..... F25D 23/021 312/297
4,962,649 A * 10/1990 Battocletti ..... F25D 23/021 62/256
2005/0088062 A1* 4/2005 Akimoto ..... A47F 3/043 312/116
2008/0078199 A1* 4/2008 Atas ..... F25D 23/021 49/506

(Continued)

FOREIGN PATENT DOCUMENTS

CN 111329245 A * 6/2020
DE 200 16 558 U1 9/2001

(Continued)

OTHER PUBLICATIONS

EPO Search Report, dated Apr. 22, 2022, 7 pages.
German Patent Office Search Report, dated Sep. 10, 2021, 6 pages.

*Primary Examiner* — Andrew M Roersma
(74) *Attorney, Agent, or Firm* — Dority & Manning, P.A.

(57) ABSTRACT

A panel system for closing and opening a merchandise space of a refrigerated cabinet includes multiple movable panels. Each panel is movable between an open position and a closed position. Two of the panel are connected to form a pair of panels. A return mechanism is arranged above the pair of panels and a pulling mechanism is guided over the deflection mechanism and connects the two panels in the pair. Each panel of the pair is disposed with respect to the deflection mechanism so that a movement of one panel in a first movement direction effectuates a movement of the second panel in a second movement direction. A refrigerated cabinet includes such a panel system.

19 Claims, 6 Drawing Sheets

(56) References Cited

U.S. PATENT DOCUMENTS

2017/0226790 A1 8/2017 Brenneis et al.

FOREIGN PATENT DOCUMENTS

| | | | | | |
|---|---|---|---|---|---|
| DE | 10 2008 010 586 | A1 | | 8/2009 | |
| DE | 20 2011 052 121 | U1 | | 1/2012 | |
| DE | 20 2015 003 240 | U1 | | 5/2015 | |
| DE | 202015003240 | U1 | * | 7/2015 | A47F 3/043 |
| EP | 1 253 274 | A2 | | 10/2002 | |
| EP | 2218363 | A1 | * | 8/2010 | A47F 3/043 |
| FR | 2799539 | A1 | * | 4/2001 | E06B 9/13 |
| KR | 200157853 | Y1 | * | 7/1999 | A47F 3/00 |
| KR | 200291318 | Y1 | * | 9/2002 | A47F 3/00 |
| WO | WO 2009/050754 | A1 | | 4/2009 | |
| WO | WO 2016/023969 | A1 | | 2/2016 | |
| WO | WO-2018232439 | A1 | * | 12/2018 | E05D 15/16 |

* cited by examiner

DISC FOR REFRIGERATION UNIT AND REFRIGERATION UNIT

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates to a pane system for a refrigerated cabinet for closing and opening a merchandise space of the refrigerated cabinet, wherein the pane system includes multiple movable panes, and wherein the panes are each movable between an open position and a closed position. The invention further relates to a refrigerated cabinet.

BACKGROUND OF THE INVENTION

Refrigerated cabinets having pane systems of the generic type are known from the related art and are utilized, for example, in supermarkets, in order to present the food for sale to the customer. Common pane systems include horizontally displaceable sliding doors or hinged glass doors.

A known embodiment of a refrigerated cabinet having horizontally displaceable sliding doors is described, for example, in DE 20 2011 052 121 U1. Such refrigerated cabinets with sliding doors have the disadvantage, however, that the sliding doors, which are displaceable in parallel in the horizontal direction, block the adjacent area and/or the adjacent sliding door in the displaced position. As a result, only one subarea of the refrigerated cabinet can be simultaneously opened.

A known embodiment of a refrigerated cabinet including hinged glass doors is described, for example, in DE 10 2008 010 586 A1. Such refrigerated cabinets with hinged glass doors have the disadvantage, however, that they represent an obstacle in front of the refrigerated cabinet in their open position.

EXEMPLARY OBJECTS AND SUMMARY OF THE INVENTION

The problem addressed by the present invention is that of eliminating the disadvantages known from the related art. The problem is, in particular, to create a pane system for a refrigerated cabinet as well as a refrigerated cabinet equipped therewith, which simplifies the accessibility to the merchandise space and/or reduces the space requirement in front of the refrigerated cabinet.

The problem is solved by a pane system for a refrigerated cabinet and by a refrigerated cabinet having the features of the independent claims.

The invention relates to a pane system for a refrigerated cabinet for closing and opening a merchandise space of the refrigerated cabinet, wherein the pane system includes multiple movable panes, and wherein the panes are each movable between an open position and a closed position. A refrigerated cabinet is to be understood as a cabinet that refrigerates the merchandise located in its merchandise space. The refrigerated cabinet can be designed as a simple refrigerated shelving unit having a plurality of merchandise compartments.

Likewise the refrigerated cabinet can include an additional refrigerated space, which is utilized for the temporary storage of the merchandise, wherein the merchandise can be moved, as necessary, from the refrigerated space into the merchandise space, which is accessible from the front. In particular, at least one door or rolling-blind arrangement is present between the merchandise space and the refrigerated space, which can be opened as necessary in order to enable a replenishment of the merchandise from the refrigerated space into the merchandise space, in particular from the back side of the merchandise compartments. A first merchandise shelving unit can be arranged in the refrigerated space and a second merchandise shelving unit spaced apart from the first merchandise shelving unit can be arranged in the merchandise space. These two merchandise shelving units can be separated from one another by the door or rolling-blind arrangement. In addition, a passage and/or storage area can be arranged between the merchandise shelving units. Such an arrangement of the refrigerated cabinet including a refrigerated space and a merchandise space has the advantage that a shared refrigeration unit for refrigerating the refrigerated cabinet can be designed to be simpler and more cost-effective. The pane system is designed as a separate unit, which is directly connected neither to the refrigeration unit nor to the refrigerated space.

The refrigerated cabinet can be operated preferably with a temperature between 9° C. and 0° C. in the merchandise space. Likewise the refrigerated cabinet can be operated as a freezer cabinet with a temperature of −18° C. or colder. The closed position is to be understood as the position of the panes, in which the panes close the merchandise space of the refrigerated cabinet toward the outside.

In particular, when the pane system is used as intended (i.e., when the pane system is connected to a refrigerated cabinet), the panes, when these are all in their closed position, are all essentially arranged adjacent to one another in such a way that the panes form one continuous pane surface, which closes the merchandise space toward the outside. Preferably, the panes in their closed position are arranged vertically one above the other and, thereby, aligned side by side.

If the panes are in their open position, however, the access into the merchandise space is unobstructed, and so merchandise can be removed from the refrigerated cabinet or placed therein.

In the open position, two or more panes in each case, preferably as viewed perpendicularly to their movement direction, are arranged at least partially one behind the other, and so the pane surface formed by the panes is smaller in the open position than in the closed position.

A pane is to be understood as a transparent element, which, in its closed position, at least thermally closes the merchandise space of the refrigerated cabinet toward the outside. Due to the transparent design, the merchandise space as well as the merchandise stored therein can be observed from the outside. The pane can include one single pane element, i.e., a single glass or plastic pane (so-called "single glass") or also multiple pane elements (multiple glass or plastic panes). The at least one pane element can be made of glass or plastic, wherein, in the case of a plurality of pane elements, these can differ from one another. In addition, at least one interior space can be formed between the plurality of pane elements, which is filled with a gas or a gas mixture, for example, a noble gas or air. The panes are preferably insulating glass panes, in the case of which at least two pane elements are connected and held apart with the aid of spacers, and so a hollow space is formed between the panes, which is closed toward the outside by the spacers and the pane elements. The spacers can be formed, at least partially and/or in sections, by a transparently cured adhesive. The panes are preferably designed in the shape of a plate, as flat panes. Alternatively, the panes can also be designed to be bent, at least in sections.

According to the invention, two panes in each case are connected with the aid of at least one pulling means and form a pair of panes, wherein the pulling means is guided over a deflection mechanism, which is preferably arranged above the panes when the pane system is used as intended, and wherein the panes connected to the pulling means are located on different sides of the deflection mechanism, and so a movement of a first pane in a first movement direction effectuates a movement of the second pane in a second movement direction. The deflection mechanism can be formed from one or multiple element(s) (preferably deflection pulleys), wherein, when the pane system is used as intended, at least one of the elements of the deflection mechanism is arranged above the panes and deflects the pulling means. Individual elements of the deflection mechanism, in particular also individual deflection pulleys if the deflection mechanism includes several such deflection pulleys, can also be arranged behind or in front of the panes when the pane system is used as intended.

A pulling means is to be understood in this case as a means that remains essentially dimensionally stable, in particular during tensile loading. Since the at least one pulling means is deflected above the panes during the use of the pane system as intended, the at least one pulling means is designed to be flexible, at least in sections, in the area of the deflection. In particular, the respective pulling means is formed by a wire cable, a chain, or, particularly preferably, by a belt. The pulling means is, therefore, an elongate, preferably flexible, element, which is connected to two panes in each case and is guided over the deflection mechanism.

A pair of panes is to be understood as two panes that are connected to each other with the aid of the at least one pulling means. Each pair of panes includes a first pane and a second pane, wherein the movement of the particular first pane in the first movement direction results in a movement of the particular second pane in the second movement direction. The first movement direction and the second movement direction can change over the course of their movement independently of one another and/or with one another. This is the case, in particular, when the panes are at least partially bent and move on a curved trajectory. The two panes of the pair of panes are arranged at the pulling means on different sides of the deflection mechanism. As a result, a weight force of the particular pane acts on each side of the deflection mechanism. This weight therefore loads the pulling means under tension and, in fact, on different sides of the deflection mechanism. If one of the panes moves upon introduction of an external motive force, the other pane also moves due to the deflection and, in fact, preferably in the opposite direction. The two panes therefore hang at different ends of the pulling means, wherein the pulling means is deflected by the upper deflection mechanism.

If the pane system has only one pair of panes and, thus, a first pane and a second pane, these are spaced apart from each other in their closed position to a minimal extent or not at all. Each of the panes covers one half of the access into the merchandise space. In the open position, the first pane and the second pane of the pair of panes are maximally spaced apart from each other.

If the pane system includes multiple pairs of panes, the first panes of each pair of panes move in the first movement direction. The second panes of each pair of panes move in the second movement direction. The panes of the multiple pairs of panes in their closed position are preferably aligned side by side in the vertical direction (wherein these can slightly overlap or adjoin one another edge to edge), as the result of which the access into the merchandise space is closed. Each of the panes covers only a fraction of the access into the merchandise space. Therefore, if the pane system includes two pairs of panes, the first pair of panes in its closed position is arranged in the center of the access into the merchandise space. The first pane of the second pair of panes is arranged adjacent to the first pane of the first pair of panes and the second pane of the second pair of panes is arranged adjacent to the second pane of the first pair of panes.

In order to open the access into the merchandise space, in the open position, completely and preferably in a space-saving manner, the particular first panes and the particular second panes of the pairs of panes can overlap, in their open position, to a large extent or completely. This yields a different distance of movement of each of the particular panes of the different pairs of panes.

In order to ensure these different distances of movement of the particular first panes of different pairs of panes and of the particular second panes of different pairs of panes at the same time, the panes of the particular pairs of panes move at different speeds. The absolute value of the speeds of the two panes of one pair of panes is the same, however, due to the connection with the aid of the at least one pulling means, and differs only with respect to its movement direction.

In the closed position, the first pane and the second pane of the first pair of panes are spaced apart from each other to a minimal extent or not at all. In this way, the refrigeration effect in the merchandise space can be ensured. The access to the merchandise, in particular to the food, is closed due to the panes being in the closed position. In the open position, the first pane and the second pane of each pair of panes are maximally spaced from each other.

The at least one pulling means is guided around the deflection mechanism in such a way that the panes arranged at the different sides of the deflection mechanism are suspended. In particular, the first pane of a pair of panes is attached at a first end of the pulling means and the second pane of the same pair of panes is attached at a second end of the pulling means. The two panes of a pair of panes are designed to be similar, preferably identical, in terms of their weight, and so the weight forces at the different sides of the deflection mechanism are essentially neutralized or canceled out. If the first pane is displaced in the first movement direction, the second pane is concurrently displaced in the second movement direction without any additional effort. In particular, the second pane of a pair of panes lowers from the closed position into the open position due to the weight force acting on it when the first pane of the pair of panes is moved upward from its closed position into its open position due to an external force effect. In this way, the panes can be very easily moved between the closed position and the open position. In addition, as a result, the panes can be stopped in different intermediate positions while moving between the open position and the closed position (or in the opposite direction), as the result of which the pane system can be opened in sections or remain closed.

It is advantageous when the pane system includes a guide arrangement, with the aid of which the panes are guided during their movement. If the first pane of the pair of panes moves in the first movement direction, a force acts upon the second pane of the pair of panes due to the deflection, as the result of which the second pane of the pair of panes is moved in the second movement direction. The guide arrangement guides the panes in their movement. If the panes are preferably designed as flat panes, the guide arrangement guides the panes in constant movement directions in each case. If the panes are designed as bent panes, the guide arrangement can guide the panes along a trajectory following the bend of the panes. The particular movement directions of the panes change on the trajectory of the bent panes and, thereby, are not constant along the movement.

It is advantageous when the first movement direction is essentially opposite the second movement direction. The movement directions are preferably held constant by the guide arrangement. The motive force that acts upon one of the panes of the pair of panes is transmitted via the pulling means onto the other pane of the pair of panes and, here, counteracts the introduced motive force due to the deflection.

It is also advantageous when the first movement direction and/or the second movement direction form(s) an angle with a vertical direction that is less than 90°, preferably less than 30°, particularly preferably equal to 0°. The pane system can therefore be utilized not only with refrigerated shelving units, but rather also with chest-type freezers, the merchandise space of which is accessible from above.

In general, it is pointed out here that spatial references (for example, top or bottom, vertical or horizontal) always relate to the use of the pane system as intended, i.e., when the pane system is part of a refrigerated cabinet and is arranged in the area of a front side facing the customer and closes a merchandise space accessible from the front (closed position of the panes) or makes the merchandise space accessible from the outside (open position of the panes).

The vertical direction is to be understood as the direction in which the weight force of the panes acts. If one of the movement directions forms an angle equal to 0° with the vertical direction, these movement directions and the vertical direction are formed in parallel to one another. If the first movement direction points in the positive vertical direction, the second movement direction points essentially oppositely in the negative vertical direction.

The smaller the spanned angle is, the smaller, therefore, is the deviation between the first and/or second movement direction(s) from the direction of the weight force.

During the movement of the panes in or through the guide arrangement, a friction force can act, which counteracts the movement. The friction force can act between the moving panes and the guide arrangement. If the spanned angle between the vertical direction and the first and/or second movement direction(s) is small, the friction force between the moving panes and the guide arrangement is also low. In addition, a small angle has the advantage that the space required for the refrigerated cabinet having a pane system of this type, in combination with a large merchandise space, can be minimized.

It is advantageous when two panes in each case are connected with the aid of at least two pulling means, wherein the two pulling means are spaced apart from one another in a horizontal direction, in particular by essentially one pane width as viewed in the horizontal direction. As a result, the panes can be hung at their two lateral ends in the horizontal direction. In this way, a tilting of the pane can be prevented and, as a result, a friction force with respect to the guide arrangement that is as low as possible can be ensured. Preferably, each pane is connected via its two upper lateral corners to one end of a pulling means in each case. The panes are designed to be rectangular, in particular, in this case. Preferably, the panes have a pane width from 500 mm to 2000 mm. In addition, the panes preferably have a pane height from 250 mm to 1000 mm.

It is also advantageous when the pane system includes an even number of panes, wherein two panes in each case form one pair of panes, the panes being connected with the aid of the at least one pulling means, preferably with the aid of two pulling means in each case. The first pane of the pair of panes moves in the first movement direction and the second pane moves—due to the connection via the one or more pulling means—in the second movement direction when the first pane is moved manually or with the aid of the drive described below. Therefore, only one pane of a pair of panes ever needs to be moved in order to simultaneously effectuate a movement of the second pane.

In order to ensure the compensation of the weight force of the panes, one of the first panes in each case is connected to one of the second panes via the at least one pulling means. If the pane system includes an even number of panes, no additional counterweight is needed for an individual pane. If the pane system has, for example, four panes, these are formed as two pairs of panes, wherein the panes of one particular pair of panes are connected to at least one pulling means, preferably to two pulling means, in each case.

If a pane system has, for example, six panes, these are subdivided into three pairs of panes having at least one pulling means each. This even number of panes is arranged in the closed position in such a way that, together, these close the access to the merchandise space of the refrigerated cabinet and form a common pane surface. For this purpose, the panes in the closed position can overlap one another or rest against each other at their horizontally extending end faces.

In general, it applies that the panes should have a rectangular shape having two opposite and vertically extending end faces and two opposite and horizontally extending end faces, wherein the four end faces define the rectangular shape of the pane.

In their open position, the panes are arranged in such a way, however, that these completely open the access to the merchandise space.

Likewise it is advantageous when, in the case of at least four panes, two of the pulling means of different pairs of panes are spaced apart from one another by at most three pulling-means widths in the horizontal direction of the panes (i.e., in their width direction as viewed from the front onto the panes) and/or in a transverse direction. The pulling-means width is to be understood as the width of one of the pulling means. One pulling-means width is several times smaller than the pane width. If the two pulling means are spaced apart from one another by less than one pulling-means width, these are arranged essentially directly next to one another. As a result, an independent movement of the two pairs of panes and their connecting pulling means can be ensured, without the pulling means rubbing against one another.

It is also advantageous when the guide arrangement includes at least one guide rail having at least one guide section for guiding at least one of the panes. The at least one pane moves within the guide section between its open position and its closed position. The at least one guide section of the at least one guide rail, together with the at least one pane, can additionally close the merchandise space in such a way that no exchange of the cool air in the merchandise space with the warm air outside arises in the closed position. Preferably, the panes are each guided in a separate guide section in the area of their vertically extending end faces.

Preferably, two guide rails are associated with one of the panes and are spaced apart from one another by at least one pane width. The pane width and the spacing of the guide rails are therefore dependent on one another. As described above, the pane width is preferably 500 mm to 2000 mm. However, pane widths of less than 500 mm and more than 2000 mm are also conceivable. The greater the pane width is, the greater is the access to the merchandise space as well.

It is also advantageous when the guide rail includes at least two guide sections, which are arranged one behind the other, for guiding at least two panes—which are arranged one behind the other—of different pairs of panes. The first panes of different pairs of panes preferably move in the same movement direction at different speeds. This also applies for the second panes of the pairs of panes. Due to the two guide sections arranged one behind the other, a compact design of the pane system in combination with providing complete access to the merchandise space can be ensured. The first pane and the second pane of a pair of panes can be guided in the same guide section, since these preferably do not overlap.

Likewise it is conceivable that the first pane and the second pane of a pair of panes are guided in different guide sections. As a result, it can be ensured, among other things, that, in the closed position of the pane system, none of the pairs of panes rest against each other edge to edge and that each pane at least partially overlaps another pane. If the pane system therefore includes two pairs of panes, the two panes of the first pair of panes in an arrangement of this type preferably overlap in the center of the access into the merchandise space.

Similarly, the guide rail for guiding three pairs of panes can include three guide sections arranged one behind the other or, in order to guide multiple pairs of panes, correspondingly more guide sections arranged one behind the other.

Likewise it is advantageous when each pane is guided, in the horizontal direction of the pane, by one guide rail or one guide section on each of the two sides. In this way, a uniform guidance of the panes can be ensured. In addition, due to the guide rails arranged on both sides, the merchandise space can be closed on both sides in the closed position, in particular without any gaps.

It is also conceivable that the panes are not guided by a guide rail, but rather in another way during their movement. For example, it would be conceivable that horizontally adjacent panes of two pane systems effectuate a mutual guidance of the panes. For example, the panes could include lateral guide elements, which engage into each other, and so one pane is guided in its movement by the guide element of an adjacent pane and is held on a desired trajectory.

Likewise it is advantageous when the deflection mechanism includes at least one deflection pulley for the deflection and/or at least one guide pulley for guiding the at least one pulling means. A deflection pulley is to be understood in this case as a pulley that deflects and, thereby, guides the at least one pulling means and at least partially, preferably completely, absorbs the weight force of the associated pair of panes. A guide pulley is to be understood in this case as a pulley that guides the pulling means, in particular after the deflection by the deflection pulley, wherein the guide pulley is preferably in contact, with the side facing away from the deflection pulley, with the pulling means. The pulling means therefore preferably extends between the deflection pulley and the guide pulley.

Likewise it is advantageous when at least two of the deflection pulleys and/or at least two of the guide pulleys are coupled to one another in such a way that these form one rotatable unit, in particular via at least one connecting shaft. The deflection pulleys and/or the guide pulleys can be coupled to each other directly and/or indirectly via at least one connecting shaft. The deflection pulleys, the guide pulleys, and/or the connecting shafts are coupled in their rotary motion. The at least two deflection pulleys and/or the at least two guide pulleys of the rotatable unit therefore rotate at the same speed. In this way, for example, two pulling means of one pair of panes can be coupled to each other in such a way that these move at the same speed.

It is also advantageous when the at least two deflection pulleys and/or the at least two guide pulleys of the rotatable unit have different diameters for reversing and/or guiding at least two associated pulling means moving at different speeds. The rotational speed of the rotatable unit can guide at different circumferential speeds due to the different diameters of the at least two deflection pulleys and/or of the at least two guide pulleys. The at least two deflection pulleys and/or the at least two guide pulleys having their different diameters provide a ratio of the speeds of the at least two pulling means. As a result, the pairs of panes arranged thereon can also be moved at different speeds.

As described above, the access into the merchandise space can be closed with multiple pairs of panes. The panes are arranged side by side or overlapping in the vertical direction. Preferably, the panes, in their closed position, are therefore arranged one below the other in the vertical direction. If the pane system therefore includes two pairs of panes having a total of four panes, the two first panes, which are arranged side by side, cover the top half of the access into the merchandise space and the two second panes, which are arranged side by side, cover the bottom half of the access into the merchandise space. In order to open the access into the merchandise space, in the open position, completely and preferably in a space-saving manner, the particular first panes can be arranged partially one behind the other in the upper area of the pane system and the particular second panes can be arranged partially one behind the other in the lower area of the pane system. In order for the panes of the particular pairs of panes, starting from different vertical positions in their closed position, to reach an identical vertical position in their open position, these must move at different speeds. This can be ensured with the aid of the pulling means moving at different speeds.

Moreover, it is advantageous when the at least one deflection pulley and/or the at least one guide pulley have/has a toothing. In this way, a force-locked connection by means of friction between the at least one deflection pulley and/or the at least one guide pulley to the pulling means can be enlarged. Additionally or alternatively, as a result, a form-locking connection between the at least one deflection pulley and/or the at least one guide pulley and the pulling means is ensured when the pulling means is designed as a toothed belt. If at least two deflection pulleys and/or at least two guide pulleys of the rotatable unit each have a toothing, the synchronization between these can be improved due to the form-locking connection.

It is advantageous when the pane system, in particular at the end of the at least one guide rail that is the lower end during use as intended, includes at least one slide-in box for the insertion and accommodation of at least one of the movable panes, preferably one half of the panes, in its open position, wherein the slide-in box is preferably covered with the aid of a movably mounted cover element when the panes moving downward during the transition from the closed position into the open position are in their open position. The slide-in box can be utilized as a protective system of the panes in their open position. The cover element, which covers the panes in their open position in the vertical direction, can move concurrently due to the movement of the panes. In this way, the cover element is flipped upward via a hinge by the panes, during their movement in the vertical direction, due to contact with the panes. If the panes move from the closed position into the open position in the vertical direction downward, the cover element can be folded downward, for example, by gravity and/or with the aid of a spring when the panes have assumed a position underneath the cover element. The cover element can also be utilized, in the open position of the panes, as a step for better access to the merchandise space.

It is also advantageous when the pane system, in particular in the area of the at least one slide-in box and/or in the area of the deflection mechanism or above the panes, includes at least one damping element (for example, in the form of a plastic bumper or a pneumatic spring) for damping the at least one movable pane upon reaching its open position and/or its closed position. With the aid of the damping element, the speed of the at least one movable pane can be gently reduced to a standstill upon reaching its open position and/or its closed position. In this way, damage of the panes can be avoided.

It is also advantageous when the pane system, in particular in the area of the guide arrangement, includes at least one lighting device. The merchandise space can be illuminated by means of the lighting device. If the lighting device is located preferably in the area of the guide arrangement, an indirect illumination of the merchandise space is ensured.

It is advantageous when the pane system, in particular in the area of the rotatable unit, includes a drive for driving at least one of the panes, in particular by means of the rotatable unit. The drive can drive the panes directly or indirectly, preferably by means of the rotatable unit, in such a way that these are moved between the open position and the closed position. The drive can drive, for example, the connecting shaft of the rotatable unit and, thereby, the deflection pulleys coupled thereto. The rotary motion of the deflection pulleys is switched via the pulling means into the first movement direction at the first end of the pulling means and into the second movement direction at the second end of the pulling means. In order to transmit the rotary motion of the deflection pulley onto the motion of the pulling means without slip, both the deflection pulley and the pulling means can be toothed. The guide pulleys are preferably not operatively connected to the drive, but rather rotate due to the contact with the pulling means when the pulling means are moved via the rotation of the deflection pulleys. Additionally or alternatively, the drive can drive at least one of the pulling means directly or indirectly, in particular via an input pinion. For this purpose, for example, the toothed input pinion can be operatively connected to the toothed pulling means. The drive can be designed, for example, as an electric motor.

Moreover, it is advantageous when the pane system includes a control unit, a safety device, a sensor unit, and/or a switching device. A sensor unit is to be understood as at least one sensor that detects motions in the surroundings of the refrigerated cabinet, in particular in front of the pane system. In this way, for example, persons who are located in front of the pane system can be detected with respect to their motion. The sensor can be designed, for example, as a photoelectric barrier or an ultrasonic sensor or as any other type of motion or proximity sensor.

A switching device is to be understood as a device that includes at least one switch, which is arranged in the surroundings of the refrigerated cabinet, in particular in front of the pane system and/or at the guide arrangement or the guide rails, and can be actuated. In this way, for example, persons who are located in front of the pane system can signal the desire to open the panes. The switch can be designed, for example, as a photoelectric barrier, a keypad, a foot switch, or as any other type of mechanical or electrical switch.

A control unit is to be understood as a unit that influences the behavior of technical integral parts of the pane system. In this way, the control unit can control, for example, the drive of the pane system in such a way that the panes open upon detection of motion by the sensor unit and/or upon or after actuation of the switching device. If no further motions or persons are detected in front of the merchandise space and/or the switching device is no longer actuated or is not re-actuated within a predefined time, in particular within fewer than 30 seconds, the panes of the pane system are closed again by the drive. For this purpose, the control unit can control the drive in such a way that the drive drives the rotatable unit and, as a result, the panes move between the closed position and the open position.

A safety device is to be understood as a device that can detect possible interference contours or persons in the functional area of the pane system, i.e., in the movement area of the panes. In this way, it can be detected, via the safety device, that persons are reaching in during the movement of the panes and the movement of the panes can be stopped. A safety device is to be understood, in particular, as a device that detects an elevated force on a drive side of the drive and, thereby, can detect a collision with a person or an interference contour. A safety device is to be understood, furthermore, as a device that can limit the force and/or the torque of the drive. The closing force of the pane system can be defined via the torque of the drive. The safety device can be an integral part of the sensor unit, of the drive, and/or of the control unit.

Additionally or alternatively, the controller can control the drive in such a way that the drive and, thereby, the movement of the panes during closing can be throttled before the closed position is reached. Due to the slower motion, persons have the possibility to clear the access to the merchandise space before the pane system reaches its closed position. The safety device is therefore integrated in the drive and/or in the controller.

Likewise the safety device and/or a further safety device can be arranged at the guide arrangement and/or the panes. This safety device is preferably designed as a clamping element, and so, in the case of a failure or defect of the drive and/or of the controller and/or at least one of the pulling means, at least one of the panes is jammed and/or tilted toward the guide arrangement by means of the clamping element. In this way, an uncontrolled closure of the pane system after a defect of this type can be avoided.

In this way, a person and/or interference contour detected by the sensor unit and/or switching device and/or safety device can be transmitted to the control unit in such a way that the movement of the panes is stopped. In this way, for example, accidents due to getting stuck can be avoided. The safety device can be an integral part of the drive and/or the control unit.

It is also advantageous when the at least one pulling means extends at least partially within the guide rail. As a result, an interfering course of the at least one pulling means in the area of the access to the merchandise space can be ruled out. In addition, injuries resulting from the moving at least one pulling means can be avoided. Advantageously, the at least one pulling means is also guided from the deflection mechanism into the guide rail by means of the at least one guide pulley.

It is advantageous when the at least one pulling means is designed as a belt, a toothed belt, a wire cable, or a chain. In this way, a force-locked connection to the pulling means by means of friction between the at least one deflection pulley and/or the at least one guide pulley can be enlarged. If, advantageously, at least one of the deflection pulleys and/or at least one of the guide pulleys additionally have/has a toothing, a form-locking connection between the at least one deflection pulley and/or the at least one guide pulley to the pulling means can be ensured, even though the guide means has an appropriate toothing.

It is also advantageous when the panes each form, at least in sections, a laminated pane having at least two individual panes extending in parallel to one another, wherein the individual panes of a pane are connected in the edge area of the laminated pane, at least in sections, with the aid of a transparent mass and/or a mass that becomes transparent after curing, preferably in the form of an, in particular cured, adhesive.

In particular, it is advantageous when the panes have a rectangular shape, wherein the individual panes are connected in the area of their horizontally extending end faces with the aid of an adhesive, which has transparently cured during the manufacture of the laminated pane. The adhesive adheres to the panes and effectuates a transmission of force between the panes, and so the panes are permanently connected to each other with the aid of the adhesive. The individual panes can also be connected with the aforementioned adhesive in the area of the vertically extending end faces. This is not absolutely necessary, however, since the vertical end faces are preferably guided in the aforementioned guide and, thereby, are not visible from the outside. In the area of the vertical end faces, the individual panes can therefore also be connected with the aid of a non-transparent adhesive. In the aforementioned area, a spacer can also be arranged between the panes and bonded thereto, in which a drying agent is preferably located, which prevents the inner sides of the pane elements from fogging up.

Preferably, the panes are designed to be frameless. In particular, when the above-described transparently cured adhesive is utilized, the pane surface that is formed by the panes in their closed position is not interrupted in the vertical direction by any non-transparent elements, and so an optimal view into the interior of the merchandise space is ensured.

Of course, it is conceivable that an edge protection profile is present, in particular, in the area of the horizontally extending end faces of the panes, which closes the panes toward the outside. The edge protection profile can be made of a transparent plastic (for example, it can be present as an extruded profile) and adhered onto the panes. A partial embedding into the transparently cured adhesive is also conceivable.

In particular, it is advantageous when counterweights are arranged in the area of the panes. The above-described panes can have different masses due to their complexity and/or due to production tolerances. In order to equalize the weight forces of the panes of a pair of panes, one or more counterweights can be arranged in the area of the panes in each case. The counterweights can be arranged directly at panes, the connecting area of which to the pulling means, or at the end of the pulling means leading to the panes. As a result, the compensation of the particular weight forces of the panes, which act upon the deflection mechanism when the pane system is utilized as intended, can be ensured.

In addition, it is advantageous when the pane system includes a supporting frame, which, in addition to the panes, supports the guide arrangement and/or the pulling means and/or the deflection mechanism and/or the slide-in box (if present) and/or the damping element (if present) and/or the lighting device (if present) and/or the drive (if present) and/or the safety device (if present) and/or the switching device (if present) and/or the sensor unit (if present) and/or the control unit (if present) and combines these to form one structural unit.

Preferably, the supporting frame includes the guide arrangement, the slide-in box, and/or a deflection box, in which the deflection mechanism is arranged. The aforementioned components therefore effectuate the stability of the unit. The supporting frame can be designed in such a way that it can be arranged, for example, in front of a refrigerated shelving unit that is open at the front and can be connected thereto. In this way, an existing refrigerated cabinet can be equipped or retrofitted with the pane system according to the invention.

In general, the supporting frame can be utilized as a supporting element for one or more further sections of a refrigerated cabinet connected to the supporting frame. For example, it is conceivable that the supporting frame is connected to a cover unit of the refrigerated cabinet and supports this toward the bottom. Additional supports for the cover unit are therefore preferably not provided in the area of the pane system.

It is also advantageous when the panes are sealed by means of sealing elements, for example, magnetic seals, plastic seals, and/or brush seals, in their closed position with respect to one another and/or with respect to the guide arrangement. The sealing elements rest against at least two panes and/or against at least one pane and the guide arrangement. As a result, in the closed position, the merchandise space of the refrigerated cabinet can be at least thermally essentially completely closed toward the outside.

It is also advantageous when the pane system includes, at the guide arrangement, at least one height adjustment element, in particular at least one adjustable pedestal. The at least one height adjustment element is arranged, for example, at the underside of the guide arrangement, in particular at at least one of the guide rails. The pane system and the refrigerated cabinet stand on an underlying surface. The at least one height adjustment element can compensate for height differences of the underlying surface between two guide rails and/or between the pane system and a frame structure of the refrigerated cabinet.

The pane system can be, in particular mechanically, connected to the frame structure of the refrigerated cabinet or rest against the frame structure and/or be decoupled therefrom. By means of the height adjustment elements, therefore, height differences between the frame structure and the pane system can also be compensated for, as the result of which a further interface adaptation is dispensed with. As a result, the pane system can also be arranged at any type of frame system.

The invention further relates to a refrigerated cabinet, which is utilized for accommodating and presenting food to be refrigerated, including a merchandise space and a pane system closing the merchandise space in a closed position. The pane system is designed according to the preceding description and is connected to a frame structure of the refrigerated cabinet, wherein the features of the pane system mentioned above or in the following can be present individually or in any combination.

In particular, the refrigerated cabinet, as explained at the outset, can be designed as a conventional refrigerated cabinet having a merchandise shelving unit and side and back walls or as a combination of a merchandise space and a refrigerated space, wherein the refrigerated space and the merchandise space are connected by way of a connection (for example, a wall with a roller blind or sliding door(s)) in order to be able to move products from the refrigerated space into the merchandise space.

It is advantageous when a guide arrangement of the pane system is arranged at a refrigerated cabinet head of the refrigerated cabinet—and is connected thereto—in such a way that the guide arrangement absorbs at least a portion of the weight of the refrigerated cabinet head and, thereby, is utilized as a support against a lowering of the refrigerated cabinet head (due to cold deformation).

Likewise it is advantageous when at least one shelf arranged in the merchandise space, which subdivide the merchandise space into individual merchandise compartments, is arranged at the guide arrangement of the pane system and is connected thereto in such a way that the guide arrangement absorbs at least a portion of the weight of the at least one shelf and, thereby, is utilized as a support against a lowering of the shelf (due to cold deformation and/or the weight force of the merchandise). It is conceivable that a simple merchandise shelving unit known from the related art is utilized as the merchandise support and/or forms the merchandise compartments. A shelving unit of this type can be arranged in the merchandise space and/or at least partially form the merchandise space.

Finally, the pane system can be connected to the merchandise shelving unit or, during use as intended, placed in front of the merchandise shelving unit and is utilized for closing a merchandise space accommodating the merchandise shelving unit toward the front, i.e., in the direction of a person who would like to place the merchandise into the merchandise space or remove the merchandise therefrom when the pane system is in its open position.

BRIEF DESCRIPTION OF THE DRAWINGS

The accompanying drawings, which are incorporated in and constitute a part of this specification, illustrate at least one presently preferred embodiment of the invention as well as features applicable to some alternative embodiments. These drawings, together with the written description, explain the principles of the invention but by no means are intended to be exhaustive of every possible embodiment of the invention. A full and enabling disclosure of the present invention is set forth more particularly in this specification, including reference to the accompanying figures. Further advantages of the invention are described in the following exemplary embodiments, wherein.

DETAILED DESCRIPTION OF EXEMPLARY EMBODIMENTS OF THE INVENTION

Figure 1:
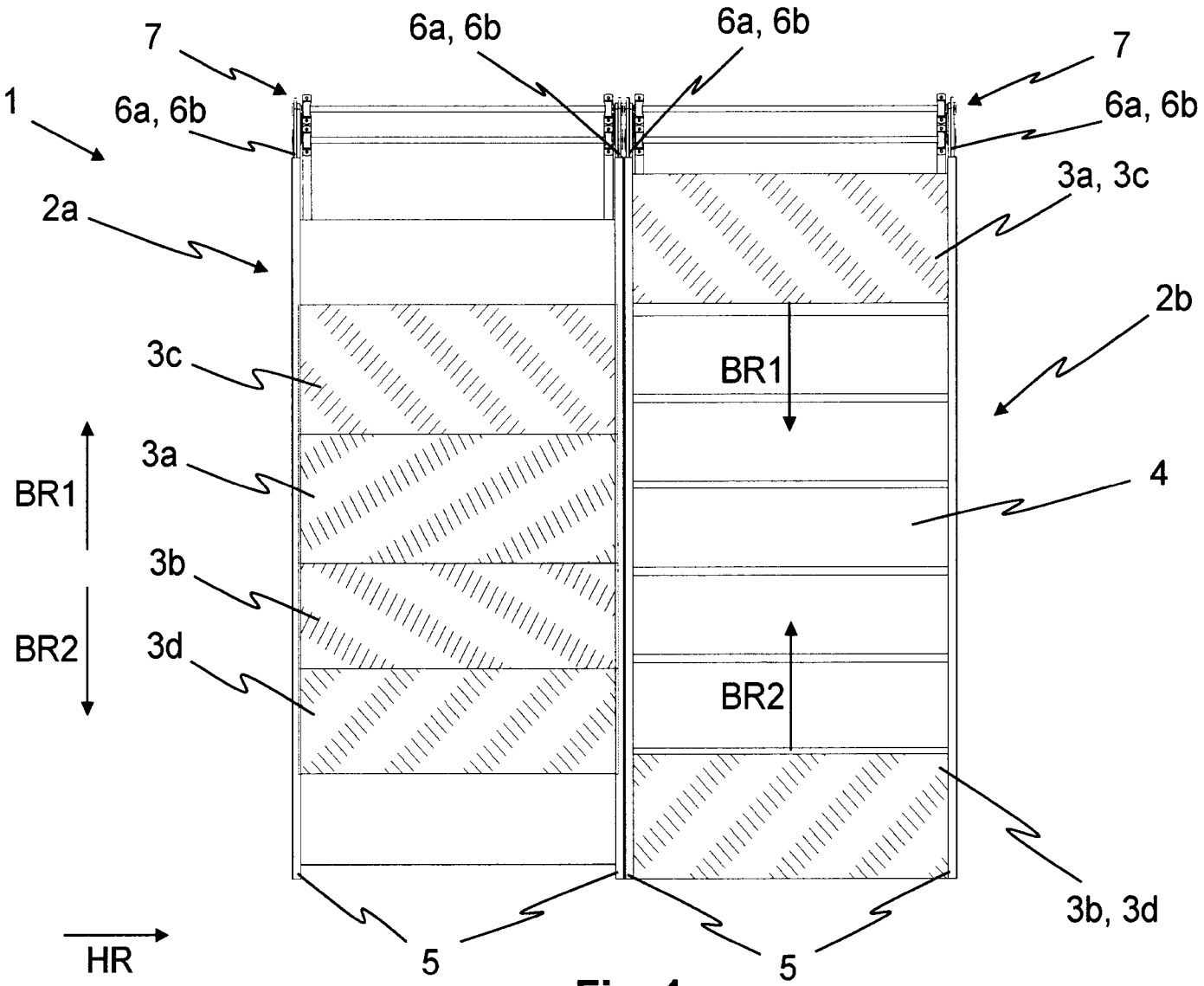
FIG. 1 shows a front view of a refrigerated cabinet having two adjacently arranged pane systems according to the invention, according to one exemplary embodiment.

FIG. 1 shows a front view of sections of a refrigerated cabinet 1 that are relevant for the understanding of the invention, with two adjacently arranged pane systems 2*a*, 2*b* according to the invention, according to one exemplary embodiment. Each of the pane systems 2*a*, 2*b* is arranged side-by-side in the horizontal direction HR in front of a base body (not shown) that defines an enclosure of the refrigerated cabinet 1 and has four panes 3*a*-3*d* arranged generally in a vertical direction. The panes 3*a*-3*d* are designed as movable panes 3*a*-3*d*. As represented here in FIG. 1, the panes 3*a*-3*d* of the pane system 2*a* are disposed in a closed position, which closes the user's access to a merchandise space 4 defined by the enclosure and situated behind the panes 3*a*-3*d* with respect to the plane of the drawing of FIG. 1. The panes 3*a*-3*d* of the pane system 2*b* are disposed so as to open the access to the merchandise space 4 in a represented open position (pane system 2*b* at the viewer's right). The merchandise space 4 schematically shown in FIG. 1 can be thought of alternatively as the merchandise space 4 of one refrigerated cabinet 1 or of two adjacently arranged refrigerated cabinets 1.

Figure 2:
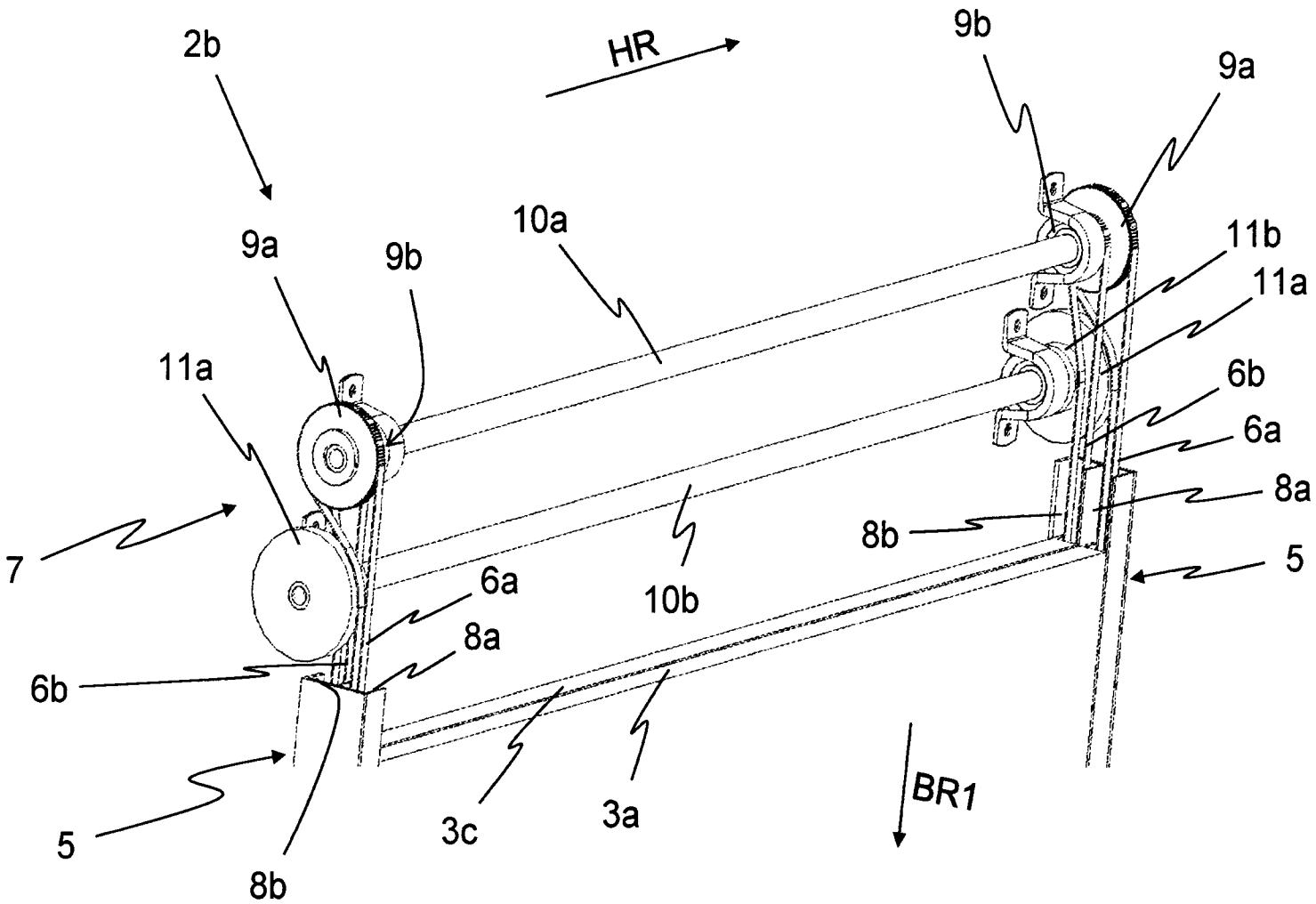
FIG. 2 shows a detail in the area of a deflection mechanism of a pane system according to the invention, according to an exemplary embodiment similar to FIG. 1.

Each of the pane systems 2*a*, 2*b* has a guide arrangement including two guide rails 5 as schematically shown in FIG. 2 for example. The panes 3*a*-3*d* are therefore configured to extend between sides in a horizontal direction HR, and each of the panes 3*a*-3*d* is guided on each of its opposite sides by a separate guide rail 5. For this purpose, the two guide rails 5 are spaced apart from one another essentially by one pane width in the horizontal direction HR.

Figure 3A:
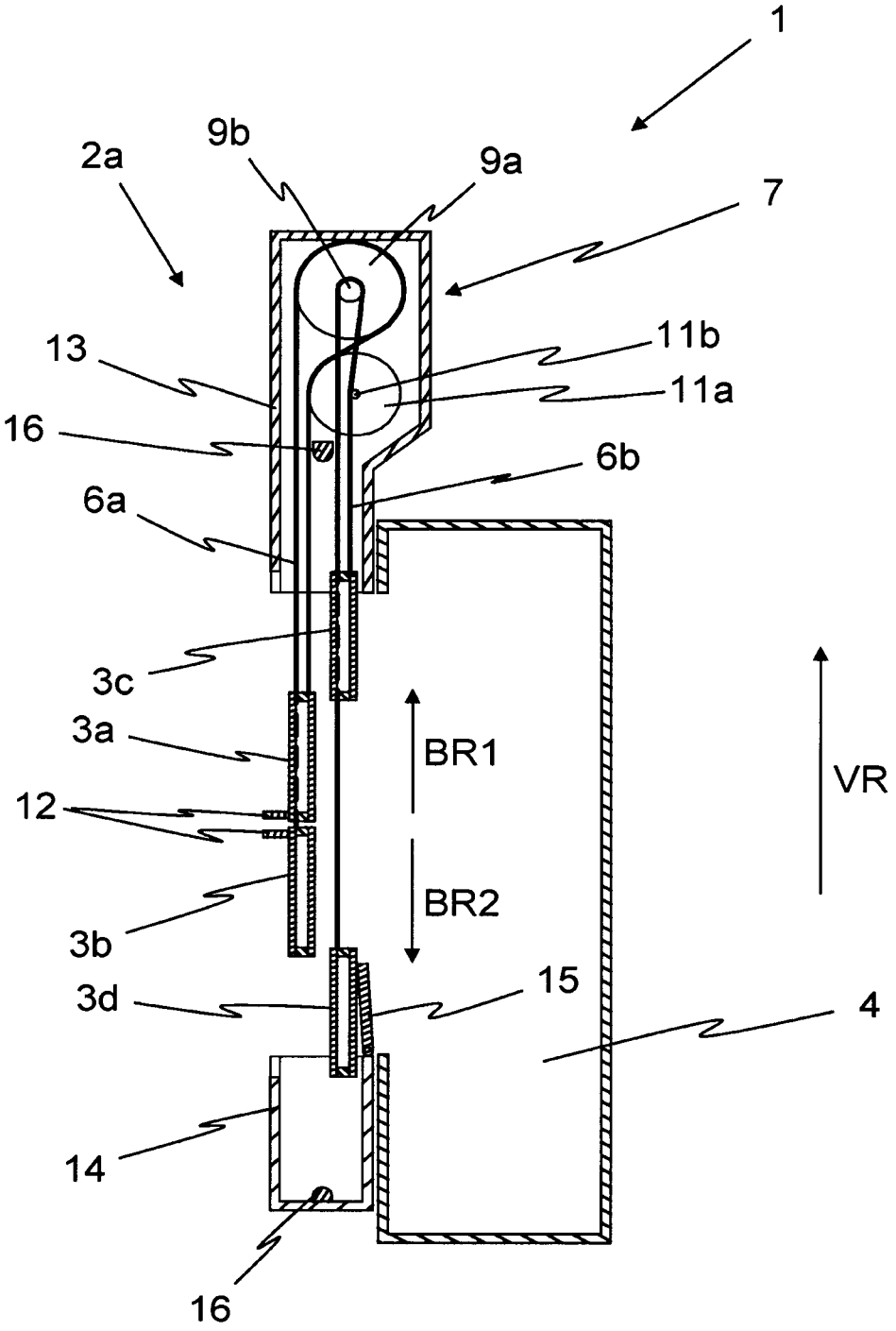
FIG. 3*a* shows a sectional representation of a refrigerated cabinet having a pane system according to the invention in a closed position according to one alternative exemplary embodiment in a plane that cuts normal to the view shown in FIG. 1.

In the exemplary embodiment shown in FIG. 1, two pulling means 6*a*, 6*b* extend within each guide rail 5. A first pulling means 6*a* in each of the two guide rails 5 is disposed on an opposite side of the two panes 3*a* and 3*b* taken in the horizontal direction HR. As schematically shown in FIG. 2, the first pulling means 6*a* on each horizontally opposite side of the two panes 3*a*, 3*b* desirably connects the two panes 3*a*, 3*b* to form a first pair of panes 3*a*, 3*b*. As schematically shown in FIG. 3*a*, the first pulling means 6*a* on one horizontally opposite side of the two panes 3*a*, 3*b* has one opposite end connected to one vertically opposite end of pane 3*a*, while the other opposite end of the first pulling means 6*a* is connected to one of the vertically opposite ends of the other pane 3*b* forming the first pair of panes 3*a*, 3*b*. The first pulling means 6*a* in the horizontally opposite side of the first pair of panes 3*a*, 3*b* is similarly connected to the respective panes 3*a*, 3*b* near their horizontally disposed opposite ends. Moreover, the two second pulling means 6*b* within the two guide rails on the opposite sides of the two panes 3*c*, 3*d* connect the two panes 3*c* and 3*d* to form a second pair of panes in the same fashion as already described for the first pair of panes 3*a*, 3*b*. As schematically shown in FIG. 2 and FIG. 3*a* for example, the particular first pulling means 6*a* of a first pair of panes 3*a*, 3*b* as well as the particular second pulling means 6*b* of a second pair of panes 3*c*, 3*d* are spaced apart from one another by approximately one pane width in a transverse direction that is normal to both the vertical direction and the horizontal direction HR. In this way, in addition to the guidance on both sides, a tilting of the panes 3*a*, 3*b*, 3*c*, 3*d* is avoided.

A deflection mechanism 7 is arranged above each pane system 2*a*, 2*b* as schematically shown in FIG. 1. The pulling means 6*a*, 6*b* are guided over the deflection mechanism 7 in such a way that the panes 3*a* and 3*b* of the first pair of panes as well as the panes 3*c* and 3*d* of the second pair of panes are located on different sides of the deflection mechanism 7. As a result, the first pane 3*a* of the first pair of panes and the first pane 3*c* of the second pair of panes move in a first movement direction BR1. The second pane 3*b* of the first pair of panes and the second pane 3*d* of the second pair of panes move simultaneously in a second movement direction BR2 essentially opposite the first movement direction BR1.

Since the pane system 2*a* is in the closed position and the pane system 2*b* is in the open position in the view shown in FIG. 1, the movement directions BR1, BR2 possible from the aforementioned positions are opposite one another. The panes 3*a*-3*d* of the pane system 2*a* in the closed position, upon switching into the open position, move away from one another along their particular movement direction BR1, BR2. The panes 3*a*-3*d* of the pane system 2*b* in the open position, upon switching into the closed position, move toward one another along their particular movement direction BR1, BR2.

The panes 3*a*-3*d* in their closed position as represented via the pane system 2*a* are aligned side by side or slightly overlap one another in the area of their particular horizontal end faces as schematically shown in FIG. 3*a*. As a result, the access to the merchandise space 4 can be completely closed. If the panes 3*a*-3*d* are arranged in their open position as represented via the pane system 2*b*, the first panes 3*a*, 3*c* and the second panes 3*b*, 3*d* are situated one behind the other in each case as schematically shown in FIG. 3*b*.

Due to the different necessary movement of the individual panes 3*a*-3*d*, different speeds of the panes 3*a*-3*d* are necessary during the movement between the open position and the closed position. As explained more fully below, this movement at different speeds is accomplished by mounting one pulling means 6*a* on a pulley 9*a* that has a different diameter than a pulley 9*b* on which the second pulling means 6*b* is mounted, while both pulleys 9*a*, 9*b* are connected via a common rotatable shaft 10*a* as shown schematically in FIGS. 2 and 3*a* for example.

In the following descriptions of the exemplary embodiments represented in FIGS. 2 through 4, the same reference characters are utilized for features that are identical and/or at least comparable to the previously described exemplary embodiment from FIG. 1 in terms of their design and/or mode of operation. Provided the features are not described in detail again, their design and/or mode of operation correspond(s) to the design and mode of operation of the above-described features.

Figure 3B:
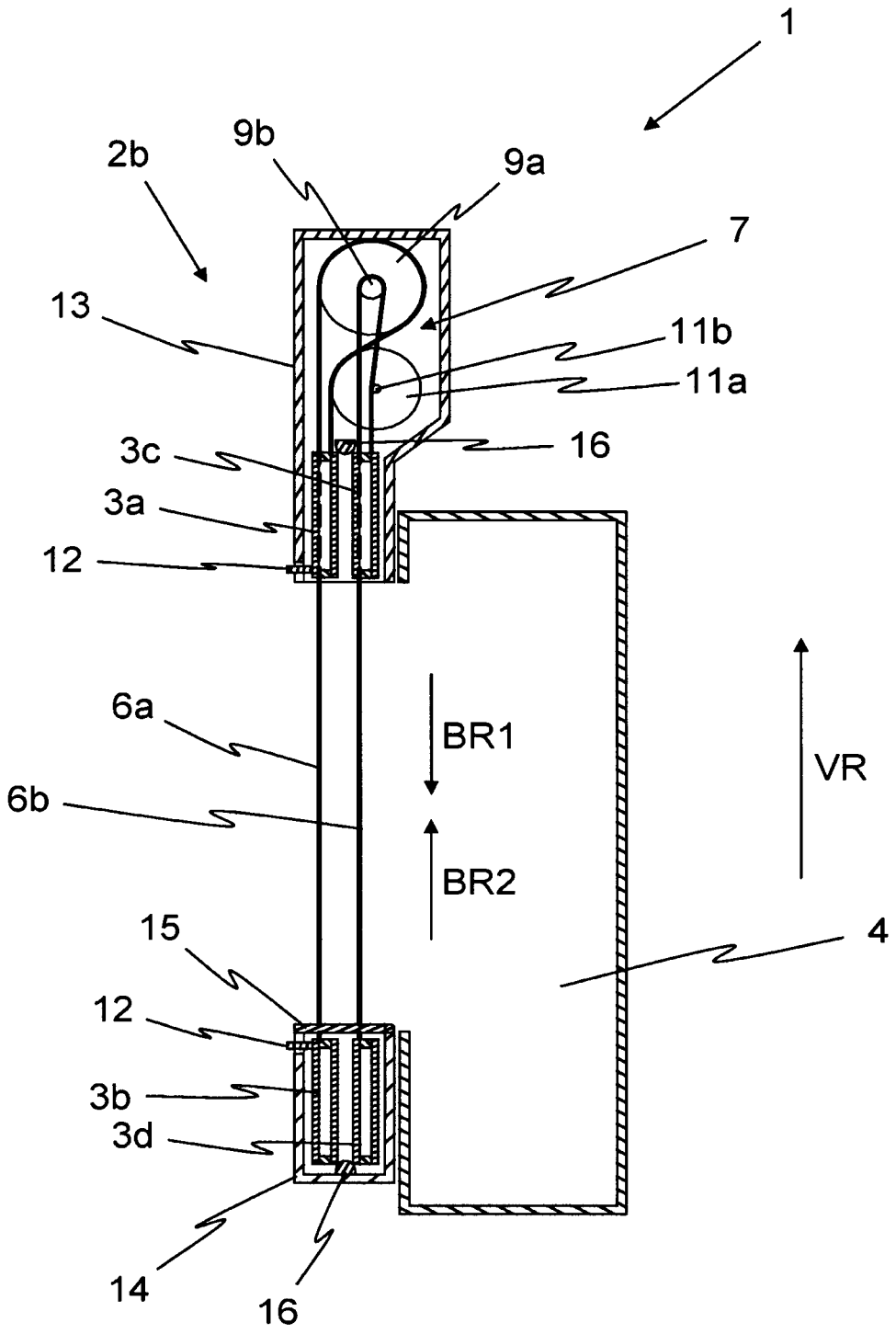
FIG. 3*b* shows a sectional representation of a refrigerated cabinet having a pane system according to the invention in an open position according to an alternative exemplary embodiment similar to FIG. 3*a*.

FIG. 2 shows a detail in the region of a deflection mechanism 7 of a pane system 2*b* according to the invention in an open position according to an exemplary embodiment similar to what is shown schematically in FIGS. 1 and 3*b*. The particular first panes 3*a*, 3*c*, in the open position represented here, are situated one behind the other in the transverse direction, which is normal to both the horizontal direction HR and the vertical direction VR (FIG. 3*b*), at their upper end position, i.e., they overlap. The two second panes 3*b*, 3*d* are not represented, for the sake of greater clarity. Reference is made to FIG. 1 in this regard. In order to guide the panes 3*a*, 3*c*, the two guide rails 5 each include two guide sections 8*a*, 8*b*, wherein the guide section 8*a* guides the first pane 3*a* of the first pair of panes and the guide section 8*b* guides the first pane 3*c* of the second pair of panes. Additionally, the second panes 3*b*, 3*d* of the particular pairs of panes represented in FIG. 1 can also be guided in the two guide sections 8*a*, 8*b*. In addition, the pulling means 6*a*, 6*b* extend within these two guide sections 8*a*, 8*b*, respectively, and connect the panes 3*a*-3*d* of the particular pairs of panes to one another.

The pulling means 6*a*, 6*b* are deflected at the deflection mechanism 7 arranged above the panes 3*a*, 3*c*. In order to ensure a smooth motion, the particular pulling means 6*a*, 6*b* are arranged at both sides of the panes 3*a*, 3*c* in the horizontal direction HR. The sides of the panes 3*a*-3*d* spaced apart from one another in the horizontal direction HR are then referred to as pane sides. The deflection mechanism 7 includes a first deflection pulley 9*a* in each case in order to deflect the particular first pulling means 6*a*. The deflection mechanism 7 includes a second deflection pulley 9*b* in each case in order to deflect the second pulling means 6*b*. The particular deflection pulleys 9*a*, 9*b*, as is also the case with the particular pulling means 6*a*, 6*b*, are spaced apart from one another in the horizontal direction HR shown schematically in FIG. 2. The first panes 3*a*, 3*c* of the two pairs of panes (3*a*, 3*b* and 3*c*, 3*d*) are arranged at the pulling means 6*a*, 6*b* on the same side of the particular deflection pulley 9*a*, 9*b* in each case. In the exemplary embodiment shown, the first pane 3*a* of the first pair of panes is arranged to be connected at the rear end of the pulling means 6*a*. The first pane 3*c* of the second pair of panes is similarly arranged to be connected at the rear end of the pulling means 6*b*. The particular other opposite end (i.e., the front end) of the particular pulling means 6*a*, 6*b* extends to the second panes 3*b*, 3*d* (see FIG. 1) of the particular pair of panes.

The two pulling means 6*a*, 6*b* of one pane side are preferably spaced apart from one another in the horizontal direction HR by one to three pulling-means width(s). In the exemplary embodiment shown, the pulling means 6*a*, 6*b* extend essentially directly next to one another. One pulling-means width is to be understood as the width of one of the pulling means 6*a*, 6*b* in the horizontal direction HR. Therefore, the two deflection pulleys 9*a*, 9*b* are also arranged directly next to one another.

The two deflection pulleys 9*a*, 9*b* have diameters that differ from one another in order to ensure different speeds of the two first panes 3*a*, 3*c* of the different pairs of panes. In order to achieve a faster speed of the two panes 3*a*, 3*b* (see FIG. 1) of the first pair of panes, the first deflection pulley 9*a* has a larger diameter than the second deflection pulley 9*b*. Additionally, as represented here, the two deflection pulleys 9*a*, 9*b* can have a toothing, which improves the frictional and/or form-locking connection to the pulling means 6*a*, 6*b*. If the pulling means 6*a*, 6*b* is preferably designed as a toothed belt, then these teeth of the toothed belt are form-lockingly engaged with the teeth of the toothed deflection pulleys 9*a*, 9*b*.

The particular adjacent deflection pulleys 9*a*, 9*b* are also directly connected to each other on one pane side in each case. If, for example, the first deflection pulley 9*a* is set into rotation by introducing a motion at a pane 3*a*, 3*b* connected via the pulling element 6*a*, the second deflection pulley 9*b* concurrently rotates at the same speed. Due to the toothing of the deflection pulleys 9*a*, 9*b*, the motions of the two panes 3*a*, 3*b* can be synchronized. Additionally, the deflection mechanism 7 includes a first connecting shaft 10*a*. The deflection pulleys 9*a*, 9*b*—which are spaced apart from one another by one pane width—of both pane sides are coupled to one another via the first connecting shaft 10*a*, and, in this way, form a rotatable unit.

In order to guide each of the pulling means 6*a*, 6*b* in such a way that these extend in the guide sections 8*a*, 8*b*, respectively, of the guide rails 5, the deflection mechanism 7 includes multiple guide pulleys 11*a*, 11*b*. Similarly to the deflection pulleys 9*a*, 9*b*, the guide pulleys 11*a*, 11*b* also have different diameters. The guide pulleys 11*a*, 11*b*, which are spaced apart from one another by one pane width, on both pane sides of one pair of panes are coupled to one another via a second connecting shaft 10*b* and, in this way, form one further rotatable unit.

FIG. 3*a* shows a sectional representation of a refrigerated cabinet 1 having a pane system 2*a* according to the invention in a closed position according to one alternative exemplary embodiment. The panes 3*a*-3*d* completely close the access to the merchandise space 4. The panes 3*a*-3*d* are represented spaced apart from each other by a gap merely for greater clarity. These can be adjacently arranged, edge to edge, as well as overlapping one another in order to completely close the access.

In the exemplary embodiment represented here, the particular panes 3*a*-3*d* of a pair of panes are guided in the same guide section 8*a*, 8*b* (see FIG. 2). In the closed position of the pane system, the two panes 3*a*, 3*b* of the first pair of panes are therefore adjacently arranged, edge to edge, in the center of the access into the merchandise space 4. If the panes 3*a*, 3*b* and/or the panes 3*c*, 3*d* are guided in different guide sections 8*a*, 8*b* (see FIG. 2), the panes 3*a*, 3*b* can overlap in the center of the access into the merchandise space 4.

The two panes 3*a*, 3*b* are connected to each other, as the first pane pair, via two first pulling means 6*a* extending one behind the other in the sheet plane. The first pane 3*a* of the first pair of panes is arranged to be connected at the rear end of the first pulling means 6*a*, and the second pane 3*b* of the second pair of panes is arranged to be connected at the front end of the first pulling means 6*a*. The first pulling means 6*a* is deflected via the first deflection pulley 9*a* in such a way that a motion of the first pane 3*a* of the first pair of panes in the first movement direction BR1 results in a motion of the second pane 3*b* of the first pair of panes in the second movement direction BR2. The panes 3*c*, 3*d* of the second pair of panes behave in a similar manner. The motion can be manually effectuated by a person standing in front of the pane system 2*a*, 2*b*. For this purpose, as schematically shown in FIG. 3*a*, both panes 3*a*, 3*b* of the first pair of panes have a handle 12.

The movement directions BR1 and BR2 both extend in parallel to a vertical direction VR. An angle spanned between the vertical direction VR and one of the movement directions BR1, BR2 is therefore equal to 0°. Therefore, the weight force of the panes 3*a*-3*d* acts in the second movement direction BR2 and counter to the first movement direction BR1. Since two panes 3*a*-3*d* are connected to each other as a pair of panes via one pulling means 6*a*, 6*b* in each case, this weight force of the panes 3*a*, 3*b* or 3*c*, 3*d* connected to a pulling means 6*a*, 6*b*, respectively, is canceled out and the panes 3*a*, 3*b* are counterbalanced, as are the panes 3*c*, 3*d*.

As represented here, the panes 3*a*-3*d* are designed, at least in sections, as a laminated pane. The laminated pane includes at least two individual panes extending in parallel to one another, wherein the individual panes are connected in the edge area of the laminated pane, at least in sections, with the aid of a transparent mass and/or a mass that becomes transparent after curing, preferably in the form of a transparently cured adhesive.

FIG. 3*b* shows a sectional representation of a refrigerated cabinet 1 having a pane system 2*b* according to the invention in an open position according to an exemplary embodiment similar to FIG. 3*a*. FIG. 3*b* therefore essentially shows the refrigerated cabinet 1 from FIG. 3*a* having panes 3*a*-3*d* displaced in the particular movement direction BR1, BR2 shown in FIG. 3*a*. The particular panes 3*a*-3*d* of each pair of panes, depicted in the open position in FIG. 3*b*, are located spaced apart by a maximum extent. The access to the merchandise space 4 is therefore open. The guide arrangement having at least one guide rail 5, as represented in FIGS. 1, 2, and 4, is not shown for the sake of greater clarity.

As shown in FIG. 3*b*, the deflection mechanism 7 is arranged at a deflection box 13, which is open at one end thereof and configured to receive therein panes 3*a* and 3*b* when disposed in their open position. In their open position, the two first panes 3*a*, 3*c* are arranged at the upper end of the pane system 2*a*, 2*b*. For this purpose, the deflection box 13 can include a receiving area for the first panes 3*a*, 3*c*. The two second panes 3*b*, 3*d* in their open position are arranged at the lower end of the pane system 2*a*, 2*b* in a slide-in box 14. The slide-in box 14 also includes a movably mounted cover element 15 for coverage. This cover element 15, in the open position, can be utilized as a step in order to ensure better access to the merchandise space 4. In the closed position and/or in a position between the closed position and the open position, the cover element 15, as represented in FIG. 3*a*, is swiveled in the direction of the merchandise space 4.

A damping element 16 is arranged in the area of the slide-in box 14 and in the area of the deflection box 13, which can dampen the movement of the panes 3*a*-3*d*. Alternatively, two damping elements 16 can be arranged in the area of the slide-in box 14 and in the area of the deflection box 13 in order to dampen the movement of each pane 3*a*-3*d* individually. If the panes 3*a*-3*d* are moved from their closed position, as represented in FIG. 3*a*, into their open position, as represented in FIG. 3*b*, the particular movement can be damped by means of the damping elements 16 in such a way that the panes 3*a*-3*d* come to a standstill.

An advertising element, which is visible from the front, can be arranged on the front side and, thereby, on the side of the refrigerated cabinet 1 represented in FIGS. 3*a* and 3*b* facing away from the merchandise space 4 in the area of the deflection box 13 and/or in the area of the slide-in box 14. The advertising element can be an electronic display and/or a display case for displaying advertisement. Likewise additional price display arrangements can be arranged in the area of the access into the merchandise space 4, in particular at the slide-in box 14, at the cover element 15, at the panes 3*a*-3*d*, or at the deflection box 13, by means of which the prices of the merchandise in the merchandise space 4 can be indicated.

Additionally, the pane system 2 can include a collision protection element on the front side and, thereby, on the side of the merchandise space 4 facing away from the merchandise space 4, in the area of the deflection box 13. This collision protection can extend in a bead-like manner along the refrigerated cabinet 1 and be utilized for protecting the pane system 2 and, thereby, in particular, protecting the panes 3*a*-3*d* against damage by shopping carts or the like.

Figure 4:
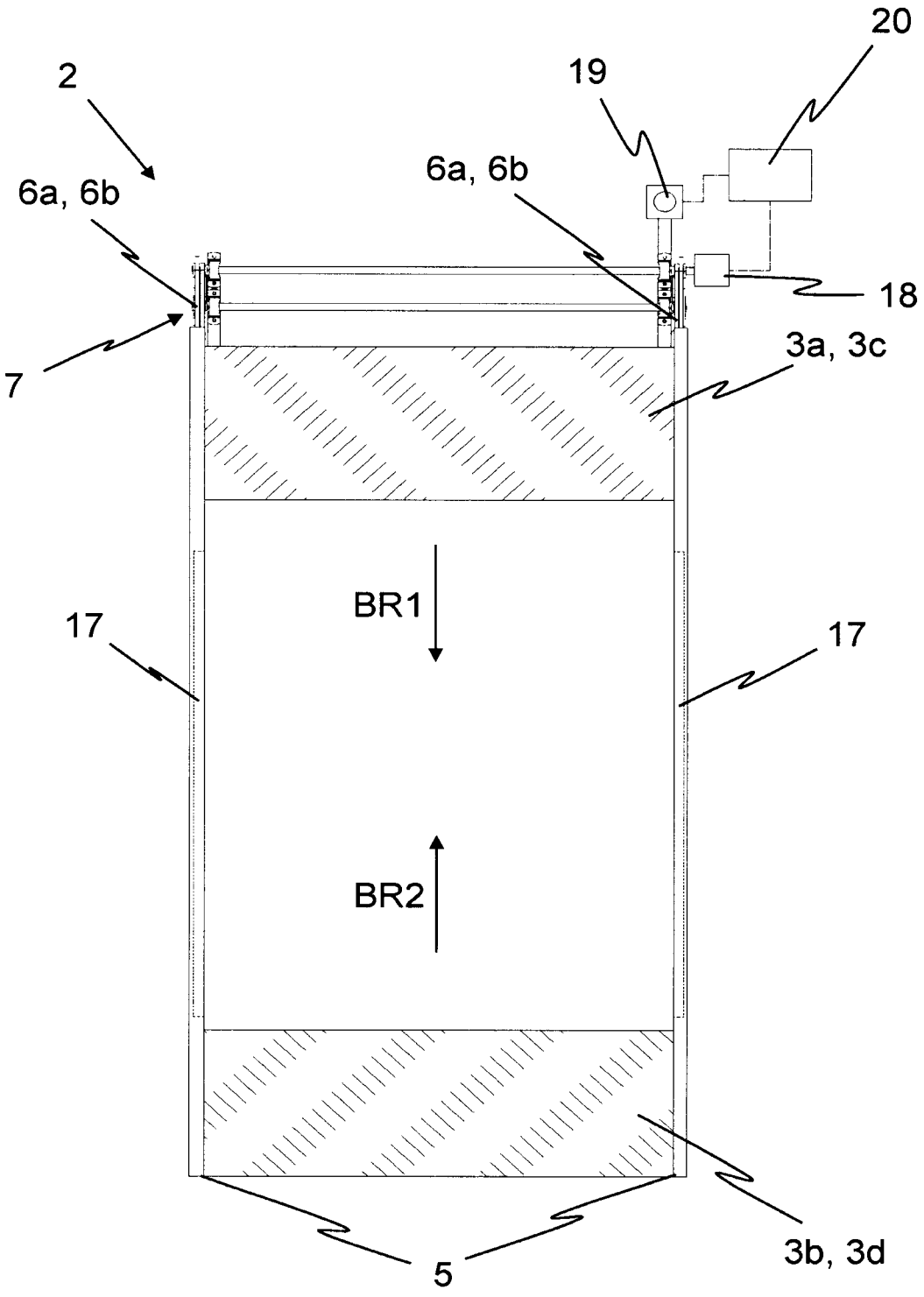
FIG. 4 shows a front view of a refrigerated cabinet having a pane system according to the invention in an open position according to one alternative exemplary embodiment.

FIG. 4 shows a front view of a pane system 2 according to the invention in an open position according to one alternative exemplary embodiment. In contrast to the preceding exemplary embodiments, only the pane system 2 is represented here. Likewise the pane system 2 can be arranged at a base body of the refrigerated cabinet 1, as represented in FIGS. 1-3*b*, and can have been connected, for example, subsequently, thereto. The pane system 2 can therefore also be retrofitted to existing refrigerated cabinets 1.

The pane system 2 has a lighting device 17 in the vicinity of each of the guide rails 5. The lighting device 17 can be, for example, an LED ribbon arranged at the back side of the particular guide rail 5.

In addition, the deflection mechanism 7 is driven by means of a drive 18, in particular in the vicinity of the rotatable unit, as described above with reference to FIG. 2. In particular, the drive 18 is operatively connected (for example, via a gear unit) to the connecting shaft 10*a*, which connects the deflection pulleys 9*a*, 9*b* to one another, and so an operation of the drive 18 effectuates a rotary motion of the connecting shaft 10*a* in the one or the other direction of rotation and, thereby, a movement of the pulling means 6*a*, 6*b* and of the panes 3*a*-3*d* connected thereto (depending on whether the panes 3*a*-3*d* are to be moved from their open position into their closed position or from their closed position into their open position).

A sensor unit 19 detects the motion in front of the pane system 2. By means of a control unit 20, the drive 18 can be controlled in such a way that the panes 3*a*-3*d* open upon detection of motion by the sensor unit 19 or close if no motion is detected. For this purpose, the control unit 20 can control the drive 18 in such a way that it drives the rotatable unit and/or the deflection mechanism 7 and, as a result, move the panes 3*a*-3*d* between the open position represented here and the closed position in its particular movement direction BR1, BR2.

Figure 5:
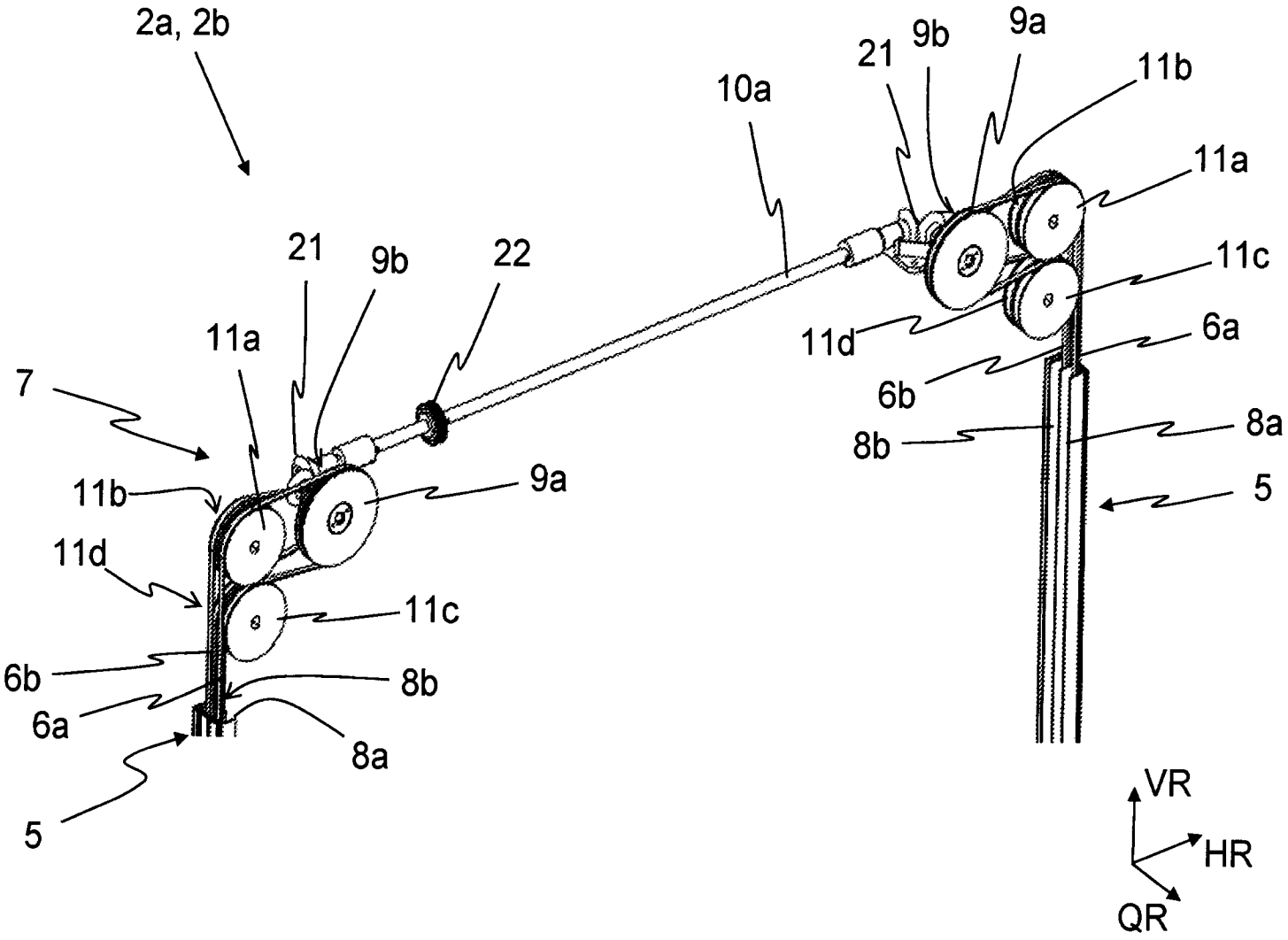
FIG. 5 shows a detail in the area of a deflection mechanism of a pane system according to the invention according to one further exemplary embodiment.

FIG. 5 shows a detail in the vicinity of a deflection mechanism 7 of a pane system 2*a*, 2*b* according to the invention according to one further exemplary embodiment. In contrast to the preceding exemplary embodiments from FIGS. 1-4, the panes 3*a*-3*d* are not represented in the present exemplary embodiment for the sake of clarity. The panes 3*a*-3*d* (not represented) are guided by means of the guide sections 8*a*, 8*b* of the guide rails 5 and are moved by means of the pulling means 6*a*, 6*b*, similarly to the preceding exemplary embodiments from FIGS. 1-4.

In the preceding exemplary embodiments, the deflection pulleys 9*a*, 9*b* and the guide pulleys 11*a*, 11*b* are aligned normal to the horizontal direction HR and are mounted onto one of the connecting shafts 10*a*, 10*b* in the horizontal direction HR. In contrast thereto, in the exemplary embodiment shown in FIG. 5, the deflection pulleys 9*a*, 9*b* and the guide pulleys 11*a*-11*d* are aligned in a plane that is normal to a transverse direction QR. This arrangement of the deflection pulleys 9*a*, 9*b* and of the guide pulleys 11*a*-11*d* results in a smaller space requirement in the transverse direction QR. The additionally necessary space requirement in the horizontal direction HR is given and/or present due to the pane width and/or due to the spacing of the guide rails 5.

The deflection pulleys 9*a*, 9*b* have different diameters in this case as well. The second deflection pulley 9*b* has a smaller diameter and, therefore, in the exemplary embodiment shown, is hidden from view behind the larger first deflection pulley 9*a*. This is apparent from the course of the second pulling means 6*b*, however, which is carried in the background of the first deflection pulley 9*a*. Due to the different diameters of the two deflection pulleys 9*a*, 9*b*, different speeds of movement are transmitted to the pulling means 6*a*, 6*b*, which are connectable to panes 3*a*-3*d* (see FIGS. 1-4).

The two pulling means 6*a*, 6*b* of one pane side are preferably spaced apart from one another in the transverse direction QR by three pulling-means widths. In the exemplary embodiment shown, the pulling means 6*a*, 6*b* extend essentially directly next to one another or are separated merely by one portion of at least one of the guide sections 8*a*, 8*b*. One pulling-means width is to be understood as the width of one of the pulling means 6*a*, 6*b* in the transverse direction QR. Therefore, the two deflection pulleys 9*a*, 9*b* and two of the guide pulleys 11*a*, 11*b* and 11*c*, 11*d*, respectively, are arranged directly next to one another.

In addition, the deflection mechanism 7 from the exemplary embodiment from FIG. 5, in contrast to the preceding exemplary embodiments, includes four guide pulleys 11*a*-11*d* on each pane side. Since the deflection pulleys 9*a*, 9*b* are offset inwardly in the horizontal direction HR, both pulling means 6*a*, 6*b* can be guided outwardly on both sides of the deflection pulley 9*a*, 9*b* by means of the four guide pulleys 11*a*-11*d*. The guide pulleys 11*a* and 11*c* guide the first pulling means 6*a* at different sides of the deflection pulley 9*a* in each case. The guide pulleys 11*b* and 11*d* guide the second pulling means 6*b* at different sides of the deflection pulley 9*b* in each case. In order for the particular sides of the pulling means 6*a*, 6*b* to be guidable past one another in the horizontal direction HR, the guide pulleys 11*a*, 11*b* are arranged offset with respect to the guide pulleys 11*c*, 11*d* by at least one pulling-means thickness. In the exemplary embodiment shown in FIG. 5, the pulling-means thickness extends in the transverse direction QR. Additionally or alternatively, the diameter of the guide pulleys 11*a*, 11*b* can differ from the diameter of the guide pulleys 11*c*, 11*d*. As a result, additionally or alternatively, the guidance of the different sides of the pulling means 6*a*, 6*b* past one another in the horizontal direction HR can be ensured.

The first connecting shaft 10*a* couples the two deflection pulleys 9*a*, 9*b* of the different pane sides to one another in this case as well. Since the deflection pulleys 9*a*, 9*b* extend normal to the transverse direction QR and the connecting shaft 10*a* extends to along the horizontal direction HR, the deflection mechanism 7 includes at least one gear unit 21. In the exemplary embodiment shown, two gear units 21 are shown, which, as bevel gear drives, bring the particular deflection pulleys 9*a*, 9*b* of one pane side into an operative connection with the first connecting shaft 10*a*. The deflection pulleys 9*a*, 9*b* can be driven by means of an input pinion 22, which is arranged at the connecting shaft 10*a* in a rotationally-fixed and/or non-displaceable manner. For this purpose, for example, a drive 18 according to the preceding exemplary embodiment from FIG. 4 can be utilized.

The present invention is not limited to the represented and described exemplary embodiments. Modifications within the scope of the claims are also possible, as is any combination of the features, even if they are represented and described in different exemplary embodiments.

LIST OF REFERENCE CHARACTERS

1 refrigerated cabinet
2*a*, 2*b* pane system
3*a*-3*d* pane
4 merchandise space
5 guide rail

6*a*, 6*b* pulling means
7 deflection mechanism
8*a*, 8*b* guide section
9*a*, 9*b* deflection pulley
10*a*, 10*b* connecting shaft
11*a*, 11*b* guide pulley
12 handle
13 deflection box
14 slide-in box
15 cover element
16 damping element
17 lighting device
18 drive
19 sensor unit
20 control unit
21 gear unit
22 input pinion
HR horizontal direction
BR1 first movement direction
BR2 second movement direction
VR vertical direction
QR transverse direction

The invention claimed is:

1. A pane system configured for closing and opening a merchandise space defined within an interior of a refrigerated cabinet, the pane system comprising:

a plurality of panes that includes a first pane, a second pane, a third pane and a fourth pane, wherein each of the first pane and the second pane is transparent, thermally insulating and disposed for movement between an open position and a closed position, wherein each of the third pane and fourth pane is disposed for movement between an open position and a closed position;

wherein the first pane and the second pane are disposed to lie in a common first plane in the closed position to form a first pair of panes;

wherein the third pane and the fourth pane are disposed to lie in a common second plane in the closed position to form a second pair of panes, wherein the second plane is disposed parallel to the first plane and displaced apart from the first plane;

a deflection mechanism configured to be carried by the refrigerated cabinet and defining a first side and a second side, which is disposed opposite the first side of the deflection mechanism;

wherein the deflection mechanism includes a first pulling means having a first end connected to the first pane, wherein the first pulling means having a second end spaced apart from the first end and connected to the second pane;

wherein the deflection mechanism is configured so that movement of the first pulling means moves the first pane in a first movement direction while simultaneously moving the second pane in a second movement direction that is opposite the first movement direction;

wherein the deflection mechanism includes a second pulling means having a first end connected to the third pane, wherein the second pulling means having a second end spaced apart from the first end and connected to the fourth pane;

wherein the deflection mechanism is configured so that movement of the second pulling means moves the third pane in the first movement direction while simultaneously moving the fourth pane in the second movement direction;

wherein the deflection mechanism includes a first deflection pulley and a second deflection pulley, wherein the first deflection pulley and second deflection pulley are coupled to one another to rotate about a common axis of rotation and rotate together to form a rotatable unit; and wherein the first deflection pulley has a first diameter and the second deflection pulley has a second diameter that differs from the first diameter so that movement of the first pair of panes occurs at a different speed than movement of the second pair of panes.

2. The pane system of claim 1, wherein each of the first movement direction and the second movement direction is parallel to a vertical direction, and wherein the first pulling means and the second pulling means are spaced apart from one another in a horizontal direction, which is perpendicular to the vertical direction.

3. The pane system of claim 1, further comprising a guide arrangement configured to constrain the movement of the first pair of panes in the first plane and the movement of the second pair of panes in the second plane.

4. The pane system of claim 3, further comprising a lighting device disposed at the guide arrangement.

5. The pane system of claim 1, wherein each of the first movement direction and the second movement direction is parallel to a vertical direction.

6. The pane system of claim 1, wherein each of the first movement direction and the second movement direction forms an angle with a vertical direction that is greater than 0° and less than 30°.

7. The pane system of claim 1, further comprising a guide arrangement configured to be carried by the refrigerated cabinet, wherein the first pulling means extends at least partially within the guide arrangement and includes at least one of a belt, a toothed belt, a wire cable, or a chain.

8. A pane system configured for closing and opening a merchandise space defined within an interior of a refrigerated cabinet, the pane system comprising:

a plurality of panes that includes a first pane, a second pane, a third pane and a fourth pane;

wherein each of the first pane, the second pane, the third pane and the fourth pane is disposed for movement between an open position and a closed position;

a deflection mechanism configured to be carried by the refrigerated cabinet and defining a first side and a second side, which is disposed opposite the first side of the deflection mechanism;

wherein the deflection mechanism includes a first pulling means having a first end connected to the first pane, wherein the first pulling means having a second end spaced apart from the first end and connected to the second pane; and wherein the deflection mechanism is configured so that movement of the first pulling means moves the first pane in a first movement direction while simultaneously moving the second pane in a second movement direction that is opposite the first movement direction;

wherein the deflection mechanism includes a second pulling means having a first end connected to the third pane, wherein the second pulling means having a second end spaced apart from the first end and connected to the fourth pane;

wherein the first pane and the second pane are disposed to lie in a common first plane in the closed position to form a first pair of panes;

wherein the third pane and the fourth pane are disposed to lie in a common second plane in the closed position to form a second pair of panes, wherein the second plane is disposed parallel to the first plane and displaced apart from the first plane; and wherein the deflection mechanism is configured so that movement of the second pulling means moves the third pane in the first movement direction while simultaneously moving the fourth pane in the second movement direction;

wherein the deflection mechanism includes a first deflection pulley and a first guide pulley configured for guiding the first pulling means;

wherein the deflection mechanism includes a second deflection pulley and a second guide pulley configured for guiding the second pulling means;

wherein the first deflection pulley and second deflection pulley are coupled to one another via a first connecting shaft to form a first rotatable unit, and wherein the first guide pulley and second guide pulley are coupled to one another via a second connecting shaft to form a second rotatable unit.

9. The pane system of claim 8, wherein the second deflection pulley of the first rotatable unit has a first diameter, wherein the second guide pulley of the second rotatable unit has a second diameter that is different from the first diameter.

10. The pane system of claim 8, wherein the first guide pulley of the second rotatable unit has a toothing, and wherein the first deflection pulley of the first rotatable unit has a toothing.

11. The pane system of claim 8, further comprising a drive connected to the first rotatable unit and configured for driving the first pulling means.

12. The pane system of claim 11, further comprising a control unit connected to the drive and configured for controlling the drive.

13. The pane system of claim 12, further comprising a sensor unit connected to the control unit and configured and disposed to detect motion adjacent to the first pane or the second pane.

14. The pane system of claim 11, further comprising a safety device connected to the control unit and configured and disposed to detect interference with the movement of the first pane or the second pane.

15. The pane system of claim 11, further comprising a switching device connected to the control unit and configured and disposed to signal the control unit to activate the drive so as to dispose the first pane and the second pane in the open position.

16. A pane system configured for closing and opening a merchandise space defined within an interior of a refrigerated cabinet, the pane system comprising:

a plurality of panes that includes a first pane, a second pane, a third pane and a fourth pane;

wherein each of the first pane, the second pane, the third pane and the fourth pane is disposed for movement between an open position and a closed position;

a deflection mechanism configured to be carried by the refrigerated cabinet and defining a first side and a second side, which is disposed opposite the first side of the deflection mechanism;

wherein the deflection mechanism includes a first pulling means having a first end connected to the first pane, wherein the first pulling means having a second end spaced apart from the first end and connected to the second pane;

wherein the deflection mechanism is configured so that movement of the first pulling means moves the first pane in a first movement direction while simultaneously moving the second pane in a second movement direction that is opposite the first movement direction;

wherein the deflection mechanism includes a second pulling means having a first end connected to the third pane, wherein the second pulling means having a second end spaced apart from the first end and connected to the fourth pane;

wherein the first pane and the second pane are disposed to lie in a common first plane in the closed position to form a first pair of panes;

wherein the third pane and the fourth pane are disposed to lie in a common second plane in the closed position to form a second pair of panes, wherein the second plane is disposed parallel to the first plane and displaced apart from the first plane; and wherein the deflection mechanism is configured so that movement of the second pulling means moves the third pane in the first movement direction while simultaneously moving the fourth pane in the second movement direction; and a guide arrangement configured to constrain the movement of the first pair of panes in the first plane and the movement of the second pair of panes in the second plane;

wherein the guide arrangement defines a lower end during use, wherein the lower end of the guide arrangement includes a slide-in box configured for accommodation of the first pane in the open position, wherein the slide-in box is covered with a movably mounted cover element when the panes are in their the open position.

17. The pane system of claim 16, further comprising a damping element disposed at the deflection mechanism and configured for damping the first pane upon the first pane reaching the open position and/or the closed position.

18. The pane system of claim 16, further comprising a damping element configured for damping the first pane upon the first pane reaching the open position and/or the closed position at the slide-in box at the lower end of the guide rail.

19. A refrigerated cabinet, which is utilized for accommodating and presenting food to be refrigerated, the refrigerated cabinet comprising:

an enclosure defining a merchandise space in an interior thereof, the enclosure further defining an opening configured to provide access to the interior of the enclosure; and a pane system configured for selectively closing the opening defined by the enclosure in a closed position, wherein the pane system includes:

a plurality of panes that includes a first pane, a second pane, a third pane and a fourth pane, wherein each of the first pane and the second pane is transparent, thermally insulating and disposed for movement between an open position and a closed position, wherein each of the third pane and fourth pane is disposed for movement between an open position and a closed position;

wherein the first pane and the second pane are disposed to lie in a common first plane in the closed position to form a first pair of panes;

wherein the third pane and the fourth pane are disposed to lie in a common second plane in the closed position to form a second pair of panes, wherein the second plane is disposed parallel to the first plane and displaced apart from the first plane;

a deflection mechanism carried by the enclosure and defining a first side and a second side, which is disposed opposite the first side of the deflection mechanism;

wherein the deflection mechanism includes a first pulling means having a first end connected to the first pane, wherein the first pulling means having a second end spaced apart from the first end and connected to the second pane;

wherein the deflection mechanism is configured so that movement of the first pulling means with respect to the enclosure moves the first pane in a first movement direction while simultaneously moving the second pane in a second movement direction that is opposite the first movement direction;

wherein the deflection mechanism includes a second pulling means having a first end connected to the third pane, wherein the second pulling means having a second end spaced apart from the first end and connected to the fourth pane;

wherein the deflection mechanism is configured so that movement of the second pulling means moves the third pane in the first movement direction while simultaneously moving the fourth pane in the second movement direction;

wherein the deflection mechanism includes a first deflection pulley and a second deflection pulley, wherein the first deflection pulley and second deflection pulley are coupled to one another to rotate about a common axis of rotation and rotate together to form a rotatable unit; and wherein the first deflection pulley has a first diameter and the second deflection pulley has a second diameter that differs from the first diameter so that movement of the first pair of panes occurs at a different speed than movement of the second pair of panes.

* * * * *